US006926461B1

(12) United States Patent
Faller et al.

(10) Patent No.: US 6,926,461 B1
(45) Date of Patent: Aug. 9, 2005

(54) HIGH-IMPACT, ENERGY-ABSORBING VEHICLE BARRIER SYSTEM

(75) Inventors: Ronald K. Faller, Lincoln, NE (US); Dean L. Sicking, Lincoln, NE (US); John R. Rohde, Lincoln, NE (US); John D. Reid, Lincoln, NE (US); Eric A. Keller, Lincoln, NE (US); Robert W. Bielenberg, Lincoln, NE (US); James C. Holloway, Lincoln, NE (US); Kenneth H. Addink, Lincoln, NE (US); Karla A. Polivka, Lincoln, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 94 days.

(21) Appl. No.: 10/118,728

(22) Filed: Apr. 8, 2002

(51) Int. Cl.[7] ..... E01F 15/00
(52) U.S. Cl. ..... 404/6; 404/10
(58) Field of Search ..... 404/6, 10; 256/13.1

(56) References Cited

U.S. PATENT DOCUMENTS

| | | | | |
|---|---|---|---|---|
| 3,049,062 | A * | 8/1962 | Irwin | 404/6 |
| 3,666,055 | A | 5/1972 | Walker et al. | |
| 3,674,115 | A | 7/1972 | Young et al. | |
| 3,680,662 | A | 8/1972 | Walker et al. | |
| 3,944,187 | A | 3/1976 | Walker | |
| 4,101,115 | A | 7/1978 | Meinzer | |
| 4,321,989 | A | 3/1982 | Meinzer | |
| 4,452,431 | A | 6/1984 | Stephens et al. | |
| 4,674,911 | A | 6/1987 | Gertz | |
| 4,681,302 | A | 7/1987 | Thompson | |
| 4,773,629 | A | 9/1988 | Yodock | |
| 4,815,565 | A | 3/1989 | Sicking et al. | |
| 4,869,617 | A | 9/1989 | Chiodo | |
| 4,946,306 | A | 8/1990 | Yodock | |

(Continued)

FOREIGN PATENT DOCUMENTS

DE 20003791 U1 * 5/2000 ..... E01F 15/10

OTHER PUBLICATIONS

Reid, John D., et al., "High Speed Crash Barrier Investigation Using Simulation", AMD-vol. 246/BED-vol. 49, Crashworthiness, Occupant Protection, and Biomechanics in Transportation Systems—2000, ASME 2000.

(Continued)

*Primary Examiner*—Gary S. Hartmann
(74) *Attorney, Agent, or Firm*—Shook, Hardy & Bacon L.L.P.

(57) ABSTRACT

A high-impact, energy-absorbing vehicle barrier system generally includes a substantially rigid outer containment wall coupled via cable restraint assemblies with an energy-absorbing inner impact wall, and energy-absorbing cartridges strategically positioned between the impact wall and containment wall. The impact wall is constructed of a number of rectangular tubes coupled with one another to presents a substantially smooth, uniform surface to passing vehicles. The energy-absorbing cartridges generally consist of a number of foam sheets which compress and crush between the containment wall and impact wall to absorb energy from an errant vehicle striking the face of the impact wall, while the deflection and deformation of the impact wall tubes dissipates additional energy to reduce peak decelerations and mitigate the severity of high-energy vehicular impacts. The splice units and quick-disconnect cable restraint system provide for relatively easy and quick replacement of damaged impact wall sections and energy-absorbing cartridges.

24 Claims, 3 Drawing Sheets

U.S. PATENT DOCUMENTS

| | | | | | |
|---|---|---|---|---|---|
| 5,125,762 | A | | 6/1992 | Strassil | |
| 5,238,228 | A | | 8/1993 | Moon | |
| 5,314,261 | A | | 5/1994 | Stephens | |
| 5,403,112 | A | | 4/1995 | Carney, III | |
| 5,425,594 | A | | 6/1995 | Krage et al. | |
| 5,605,413 | A | | 2/1997 | Brown | |
| 5,645,368 | A | | 7/1997 | Yunick | |
| 5,660,496 | A | | 8/1997 | Muller et al. | |
| 5,797,592 | A | | 8/1998 | Machado | |
| 5,823,584 | A | | 10/1998 | Carney, III | |
| 5,851,005 | A | | 12/1998 | Muller et al. | |
| 5,860,762 | A | | 1/1999 | Nelson | |
| 5,882,140 | A | | 3/1999 | Yodock, Jr. et al. | |
| 5,915,876 | A | * | 6/1999 | Barbazza | 404/6 |
| 5,921,702 | A | * | 7/1999 | Fitch | 404/6 |
| 5,947,452 | A | | 9/1999 | Albritton | |
| 6,004,066 | A | * | 12/1999 | Niemerski | 404/6 |
| 6,007,269 | A | * | 12/1999 | Marinelli | 404/6 |
| 6,010,275 | A | * | 1/2000 | Fitch | 404/6 |
| 6,024,341 | A | | 2/2000 | Gertz | |
| 6,048,138 | A | * | 4/2000 | Lamberson et al. | 405/262 |
| 6,082,926 | A | * | 7/2000 | Zimmer | 404/6 |
| 6,149,134 | A | * | 11/2000 | Bank et al. | 256/13.1 |
| 6,488,268 | B1 | * | 12/2002 | Albritton | 256/13.1 |
| 6,530,560 | B2 | * | 3/2003 | King | 256/1 |
| 6,536,986 | B1 | * | 3/2003 | Anghileri et al. | 404/6 |
| 6,540,434 | B1 | * | 4/2003 | Hotchkin | 404/6 |
| 6,551,010 | B1 | * | 4/2003 | Kiedaisch et al. | 404/6 |
| 6,554,530 | B2 | * | 4/2003 | Moore | 404/6 |
| 6,604,888 | B2 | * | 8/2003 | Dolan | 404/6 |
| 2003/0081997 | A1 | * | 5/2003 | Kramer | 404/6 |

OTHER PUBLICATIONS

Giavotto, V., et al. "Vehicle Dynamics and Crash Dynamic with Minicomputer", Program Development & Technical Appliance Ltd. SPAT, Alberata 401, Milano 2 SEGRATE, Italy and Institute for Road Saftey Research SWOV, Duindorn 32, Leidshendam, The Nederlands, *Computer Structures*, vol. 16, No. 1-4, pp. 381-393, 1983.

Fitch, John D., et al. "Impact Attenuation Devices for Racing", Impact Dynamics, L.L.C., and Safety Quest, Inc., Society of Automotive Engineers, Inc., pp. 199-208, 1998.

Reid, John D., et al. "High Speed Crash Barrier Investigation Using Simulation" AMD-vol. 246/BED-vol. 49, Crashworthiness, Occupant Protection, and Biomechanics in Transportation Systems, ASME 200.

* cited by examiner

HIGH-IMPACT, ENERGY-ABSORBING VEHICLE BARRIER SYSTEM

STATEMENT REGARDING FEDERALLY SPONSORED RESEARCH OR DEVELOPMENT

Not applicable.

CROSS-REFERENCE WITH RELATED APPLICATIONS

Not applicable.

BACKGROUND OF THE INVENTION

In recent years, automobile racing has become one of the most popular sporting events in the United States and abroad. Auto racing's popularity is evidenced by the number of weekend auto races, extensive fan support and corporate sponsorship, and 24-hour cable television coverage. In addition, the sport's popularity is seen in the wide variety of race series available for drivers and spectators, including the Indy Racing League (IRL), NASCAR's WINSTON CUP, BUSCH, and Truck series, FORMULA 1, CART, and IROC.

In automobile racing, high-performance vehicles travel many times around an oval track at very high speeds. Many of these tracks utilize outer retaining or containment walls, typically in the form of substantially rigid concrete barriers, to prevent race vehicles from leaving the track. Unfortunately, race vehicles frequently lose control and impact the rigid outer containment wall, resulting in high-impact energies and, occasionally, driver injuries and fatalities. Errant vehicles and driver injuries and fatalities do not occur only on race tracks, but on highways, interstates, autobahns, and other public roadways in the United States and abroad. An improved barrier system can mitigate the severity of high-speed, high-energy automobile accidents and potentially reduce the number of injuries and fatalities on race tracks and public roadways.

Over the years, there have been many efforts to advance the state of the art of safety barrier design and construction. Some of the simpler proposed solutions consisted of loosely-stacked foam blocks placed around the outer, exterior walls of the track or roadway to reduce the severity of impact between the errant vehicle and the rigid wall. An impacting vehicle, however, can penetrate these foam blocks and strike the retaining wall with little or no impact energy having been absorbed by the blocks. Further, portions of the foam blocks can be knocked onto the track or roadway by the impacting vehicle, creating a hazard for other vehicles that follow. Other barrier designs have incorporated used rubber automobile tires banded together at selected regions of road courses. Although these tire barriers offer significant impact attenuation, these systems capture virtually all impacting vehicles, significantly increasing the total velocity change during the crash and greatly increasing the risk of driver injury or fatality. Further, tire barriers can allow vehicles to under-ride the barrier and lead to intrusion into the vehicle's occupant compartment. This type of system is generally appropriate only for locations where vehicle redirection is not practical, such as the gore areas created at tight hairpin turns.

In the late 1990's, a barrier system known as the FLAG barrier was developed. The FLAG barrier was a compression-type barrier consisting of large diameter, thick-walled resilient cylinders attached to a rigid concrete racetrack wall. The cylinders were placed adjacent one another, forming a longitudinal row of cylinders positioned along the track side. Smaller diameter cylinders were placed on the traffic-side face of the longitudinal barrier and positioned and attached at the recessed regions between the larger cylinders to minimize the potential for vehicle pocketing. This barrier system was crash tested using a 1,248 kg. vehicle impacting at a speed of 121.0 km/hr and an angle of 20.8 degrees. After compressing several of the cylinders, the test vehicle was smoothly redirected, exiting the system at a speed of 70.0 km/hr and an angle of 15.0 degrees. However, the vehicle's velocity change and exit angle were both relatively high.

In 1998, a polyethylene energy dissipating system (PEDS) was developed for use on oval racetracks. The PEDS barrier system was configured using high-density polyethylene (HDPE) cylinders covered by a thick HDPE skin on the front and top of the cylinders. To expedite construction and repair of the PEDS system, the barrier was designed and fabricated in modular units attached to the concrete wall using a cable restraint system. The cover skin was used to reduce the potential for vehicle pocketing in the front face and reduce or eliminate the potential for the driver's extremities becoming caught in the openings between the cylinders. During the running of an IROC race at the Indianapolis Motor Speedway in August, 1998, driver Arie Luyendyk was involved in a crash which resulted in his IROC car impacting rearward on the PEDS barrier installed downstream from the inside corner of turn four. The estimated impact condition for this event consisted of a 1,633 kg car striking the barrier at a speed of 209 km/hr and an angle of 32 degrees. Remarkably, the driver sustained no serious injury from this severe impact event. These relatively positive results were attributed to the PEDS barrier and the excellent energy management of IROC vehicles during rearward impacts. The PEDS barrier, however, sustained significant damage, and debris was spread across the racing surface. Based on the impact performance of the PEDS barrier, several modifications were made to increase its energy-absorbing capabilities and prevent the units from becoming dislodged.

Beginning in 1999, researchers at the Midwest Roadside Safety Facility (MwRSF) in Lincoln, Nebr., in cooperation with IRL and NASCAR, investigated several energy-absorbing barrier concepts for use in high-speed racetrack and roadway applications using both computer simulation modeling and full-scale vehicle crash testing. The energy-absorbing and potential of both HDPE and foam materials were investigated. This testing and simulation indicated that HDPE barrier systems allowed impacting vehicles to gouge into the material and create snagging and pocketing, indicating to the MwRSF researchers that HDPE barrier faces offered no improvements or advantages over concrete barriers.

Simulation and testing of vehicle barriers indicates that lateral accelerations imparted to impacting vehicles and their occupants can be greatly reduced by adding even modest amounts of energy dissipation to rigid barrier systems. Further, testing has indicated that the utilization of relatively stiff longitudinal barrier elements would minimize vehicle rebound from the barrier. Subsequently, an energy-absorbing barrier system utilizing rubber energy absorbers with steel reinforced fiberglass fender panels was developed. This barrier design included a cable and strut mechanism by which the fender panels were attached to the vertical concrete backup structure to allow the barrier to deflect rearward with limited longitudinal motion. However, the relatively short "fish scale" fender panels and the soft energy absorbers utilized in this barrier caused the system to deform around the front of the impacting vehicle, increasing the potential for snagging and/or high rebound angles at increased impact speeds. Further, the cables and struts used to mount the barrier to the backup structure also posed potential snagging problems during high-speed impacts.

SUMMARY OF THE INVENTION

Accordingly, it is an object of the present invention to provide an energy-absorbing vehicle barrier system for use on high-speed race tracks and public roadways.

Another object of the present of the invention is to provide an energy-absorbing vehicle barrier system that reduces the potentially harmful deceleration forces experienced by an impacting vehicle and its occupants.

It is a further object of the present invention to provide an energy-absorbing vehicle barrier system that reduces or eliminates the potential for vehicle pocketing, gouging, or snagging in either direction of travel.

Yet another object of the present invention is to provide an energy-absorbing vehicle barrier system comprised of readily-available materials and that may be relatively easily and quickly repaired following a damaging vehicle impact.

The present invention provides for a high-impact, energy-absorbing vehicle barrier system. The barrier system generally includes a substantially rigid outer containment wall coupled via cable restraint assemblies with an energy-absorbing inner impact wall, and energy-absorbing cartridges strategically positioned between the impact wall and containment wall. A preferred embodiment of the barrier system of the present invention includes an impact wall comprised of a plurality of rectangular cross-sectioned structural steel tubes welded to one another to present a substantially smooth, uniform wall to passing vehicles. The impact wall generally consists of a number of impact wall sections coupled with one another by sliding splice units having beveled end faces. The face of the impact wall may be coated with a lubricant, such as zinc-rich paint, to further minimize friction between the impact wall and an errant, impacting vehicle. The energy-absorbing cartridges, which in a preferred embodiment consist of a plurality of foam sheets, compress and crush between the containment wall and impact wall and absorb energy from a vehicle striking the face of the impact wall. The deflection and deformation of the impact wall tubes toward the containment wall further dissipates energy of the impacting vehicle. The barrier system of the present invention is suitable for use on high-speed race tracks and public roadways, significantly reduces peak vehicular decelerations experienced by an impacting vehicle and its occupants, minimizes the potential for vehicle gouging, snagging, or pocketing in either direction of travel, and mitigates the severity of high-energy vehicular impacts. The cable restraint assemblies and sliding splice units provide for relatively easy and quick removal and replacement of damaged impact wall sections.

The new, high-impact, energy-absorbing barrier system of the present invention was developed to mitigate the severity of high-energy vehicular impacts. In impacts with rigid walls, vehicular decelerations are often maximized as the rigid wall does not displace and substantially all of the impact energy must be dissipated by the vehicle structure (e.g. the vehicle body, engine, transmission, tires, etc.). The new barrier system of the present invention reduces the severity of an impact when a vehicle strikes a containment wall at a high speed. The system reduces or eliminates snagging or pocketing in both directions of vehicle travel and also provides energy dissipation in both the impacting vehicle and the energy-absorbing barrier, significantly reducing peak vehicular and vehicle occupant decelerations when compared to the decelerations observed during an impact with a rigid containment wall. The mitigation of these high vehicular decelerations greatly reduces the potential for serious injury or fatality as a result of the impact with the exterior containment wall.

The barrier system of the present invention is designed primarily for use as protection for errant vehicles at high-risk locations such as on the outside of curves on race tracks and heavily congested high-speed roadways. Since this new barrier is primarily, but not exclusively, a longitudinal barrier, the technology has potential application as a roadside barrier in high accident locations such as curves in tunnels and congested roadways. The technology also has application in retrofitting rigid bridge railings and other permanent or temporary traffic barriers. For longitudinal barrier applications, the system would primarily be intended to mitigate the severity of oblique-angle vehicular impacts. However, this technology may also be applied to severe, high-impact events where perpendicular impacts to the system are anticipated. These higher-severity events include situations where crash cushions, end terminals, and truck-mounted or trailer-mounted attenuators are required.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF PREFERRED EMBODIMENT

Figure 1:
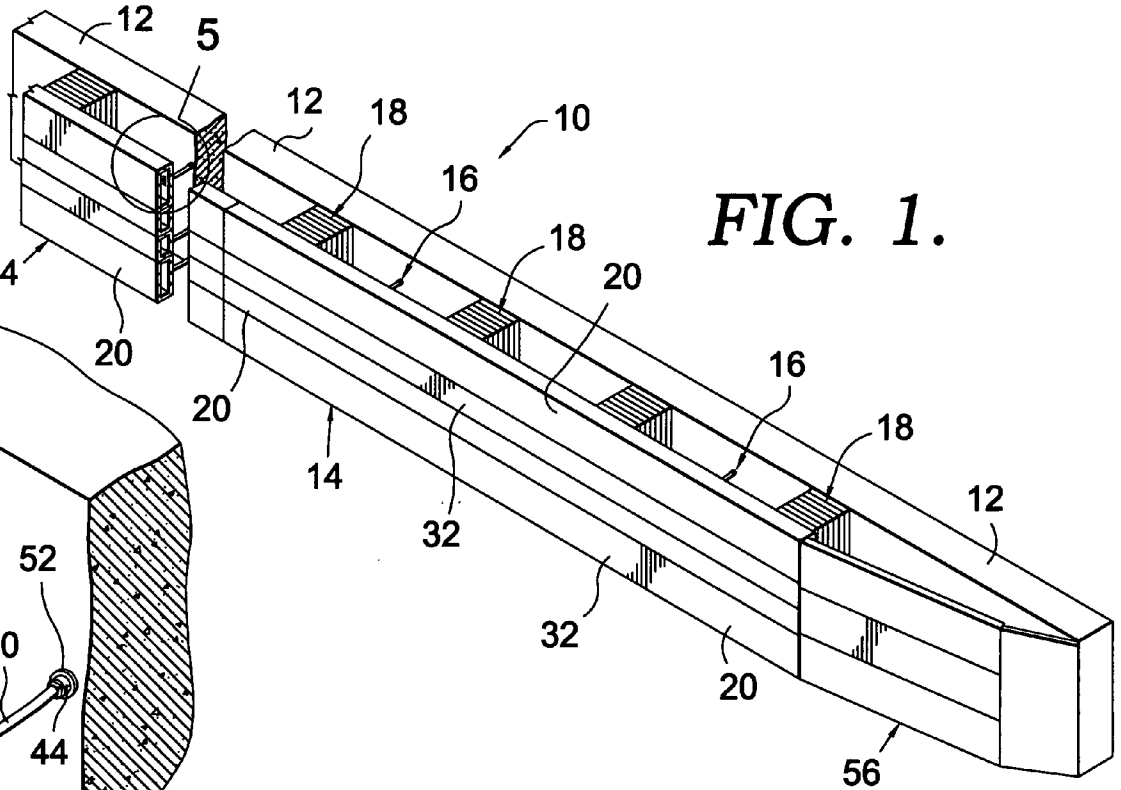
FIG. 1 is a perspective view of an energy-absorbing vehicle barrier system, with parts broken away to show particular details of construction.

Referring to the drawings in greater detail, and initially to FIG. 1, a high-impact, energy-absorbing vehicle barrier system of the present invention is designated by the numeral 10. The barrier system 10 generally includes a substantially rigid containment wall 12, an energy-absorbing impact wall 14, a number of cable restraint assemblies 16 coupling the containment wall 12 with the impact wall 14, and a number of energy-absorbing cartridges 18 positioned between the containment wall 12 and the impact wall 14. It will be understood that the walls 12 and 14 of the barrier system 10 may be relatively straight (as depicted in FIG. 1) for use adjacent race track straightaways, for example, and/or the walls 12 and 14 may be curved for barrier system 10 installations adjacent to race track or roadway turns having a radius.

The containment wall 12 is generally constructed of heavily reinforced concrete, but may be constructed of steel, stone, or other substantially rigid material. The impact wall 14 of the present invention is configured such that it can be easily attached to an existing containment wall 12 such as those typically used at race tracks and high-speed tunnels, or an entire barrier system 10, including impact wall 14 and containment wall 12, may be constructed for newly-constructed race tracks and roadways.

Figure 5:
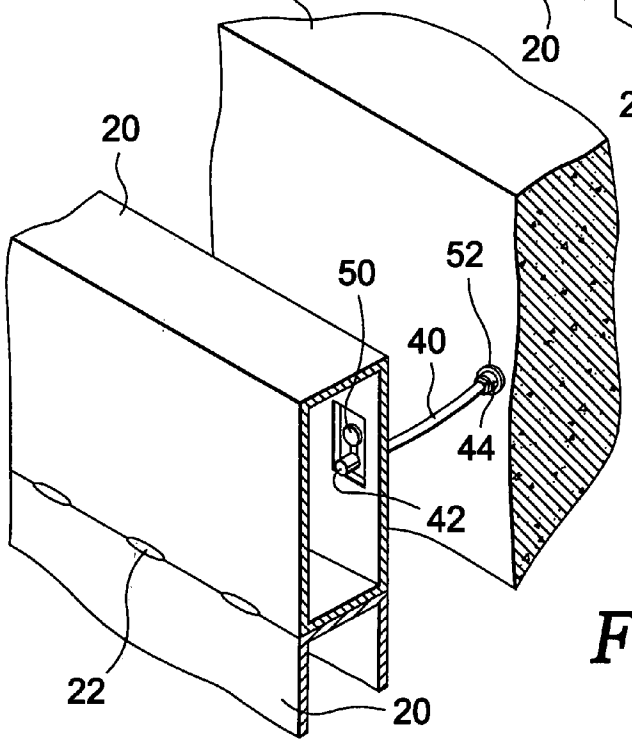
FIG. 5 is an enlarged view of the encircled region labeled 5 in FIG. 1.
Figure 4:
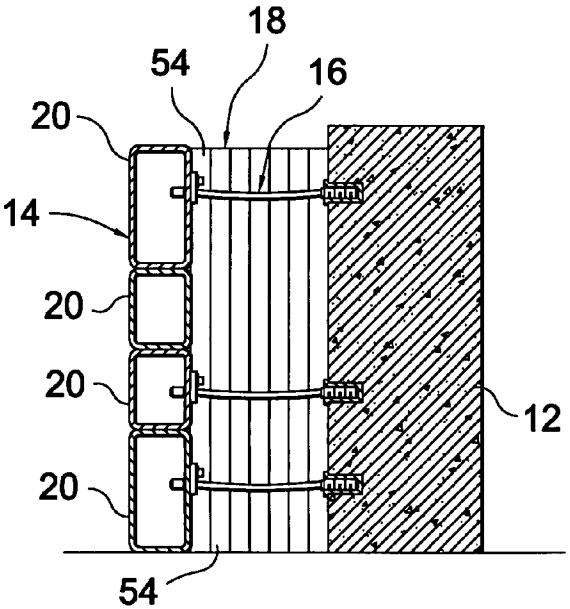
FIG. 4 is a cross-sectional view taken along line 4—4 of FIG. 2.
Figures 6, 7:
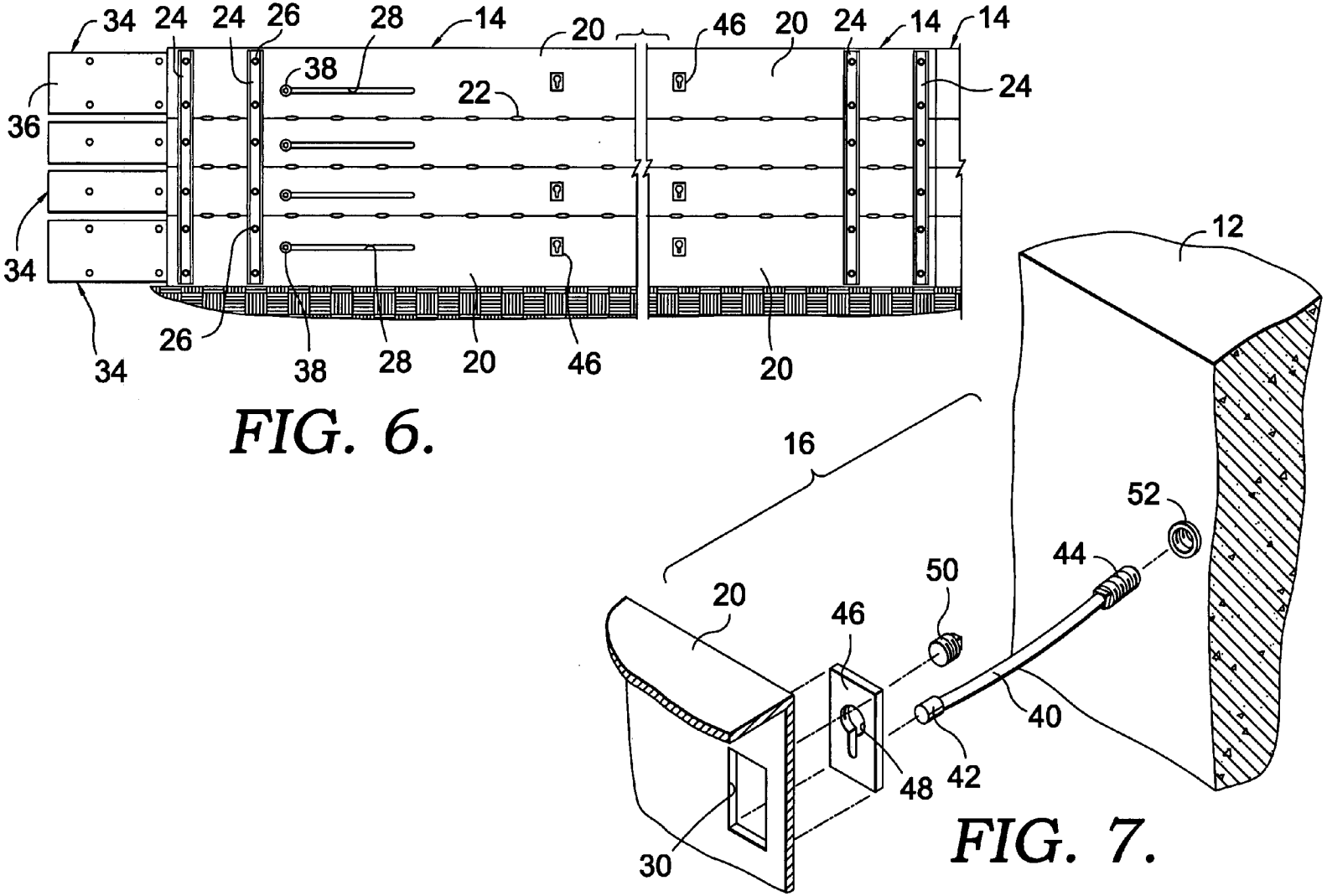
FIG. 6 is a cross-sectional view taken along line 6—6 in FIG. 2.
FIG. 7 is a view similar to FIG. 5 with parts being exploded.

As best seen in the embodiment depicted in FIGS. 1 and 4, the impact wall 14 is preferably constructed from a series of structural steel tubes 20. Tubes 20 are hollow, preferably have a rectangular or square cross-section, and preferably are constructed of ASTM A500 Grade C steel having a tube wall thickness of 3/16 inches. As best seen in FIGS. 6 and 7, elongated slots 28 and keyhole plate apertures 30 are formed in the inner walls of tubes 20. It will be understood by one skilled in the art that tubes 20 may be constructed of a variety of materials having varying dimensions and wall thicknesses suitable for dissipating energy of an impacting vehicle and resistant to snagging, pocketing, or gouging. The materials and wall thickness are selected based upon the desired energy absorption. As seen in FIGS. 5 and 6, tubes 20 are preferably coupled with one another by a series of stitch or skip welds 22 spaced along the inner and outer faces of the tubes 20 to form impact wall 14 and presenting a substantially uniform, smooth face along the edge of the track or roadway. Tubes 20 may also be continuously welded to one another, but stitch or skip welds 20 are preferred, as the energy of an impacting vehicle may, under some impact conditions, be additionally dissipated in a controlled manner as the tube 20-weld 22 interface fractures and gives way under the force of the impacting vehicle. As best seen in FIG. 6, tubes 20 are further coupled with one another at their inner faces by brace members 24 extending across the inner faces of tubes 20 and perpendicular to the long axes of tubes 20. Brace members 24 are preferably constructed of steel channel fixed to tubes 20 by welding and/or by use of brace bolts 26 that extend through brace members 24 and into or through bolt holes or apertures formed in the inner walls of tubes 20.

When welded or otherwise coupled with one another, tubes 20 form the impact wall 14 and, as seen in FIG. 1, present a relatively smooth, continuous face to impacting vehicles that spreads the vehicle impact forces and the deflection of wall 14 over a relatively large area. The face of wall 14 is preferably substantially vertical, as best seen in FIG. 4. This impact wall 14 configuration also minimizes the potential for vehicle capture, gouging, pocketing, or snagging and serves to redirect an impacting vehicle at a relatively low exit angle relative to the wall 14. The outer, traffic-side face of wall 14 is preferably galvanized or coated with a zinc-rich paint, low-friction lubricant, or other material 32 to further reduce friction between the impact wall 14 and an impacting vehicle, reduce the change in velocity of the impacting vehicle and driver, and reduce the exit angle of the impacting vehicle. The lower surface of impact wall 14 may rest directly on the surface of the race track or roadway, as depicted in FIG. 6, or may be elevated slightly from the track or roadway surface by use of shims or supports positioned between the lower barrier surface and the surface of the track or roadway to permit water drainage and facilitate removal of debris from between wall 12 and wall 14.

The use of structural steel tubes 20 to form the impact wall 14 allows the wall 14 to be manufactured from readily-available structural materials and permits a wide range of barrier height, as measured from the track or roadway surface to the top of the device. In a preferred embodiment for use at the Indianapolis Motor Speedway in Indianapolis, Ind., impact wall 14 is formed of four (4) structural steel tubes 20 each having a rectangular cross section and a width of six (6) inches, the bottom tube 20 having a height of approximately twelve (12) inches, the two (2) inner tubes 20 each having a height of approximately eight (8) inches, and the upper tube 20 having a height of approximately ten (10) inches, for a total impact wall 14 height of approximately thirty eight (38) inches. It will be understood, however, that impact wall 14 may be constructed of a single unitary member or tube 20, or may be constructed of any number of tubes 20 or other structural members having varying dimensions and wall thicknesses.

Figure 2:
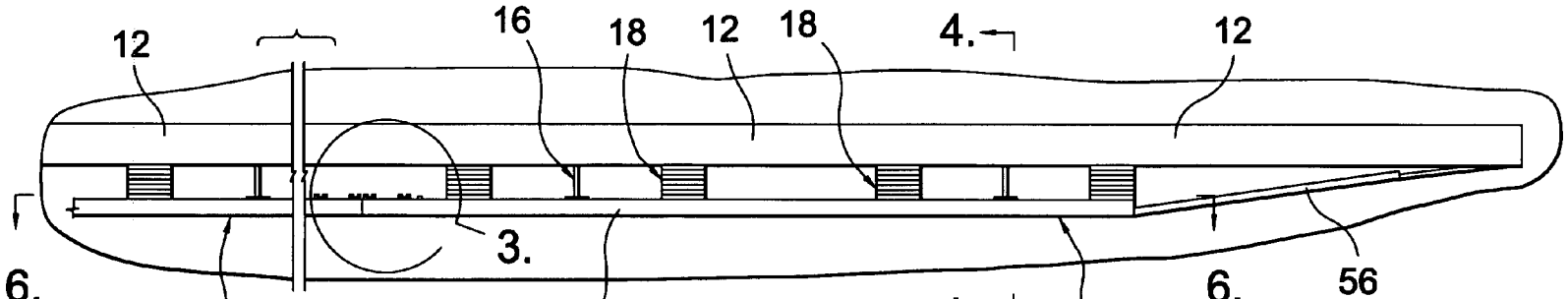
FIG. 2 is a top plan view of the system of FIG. 1.
Figure 3:
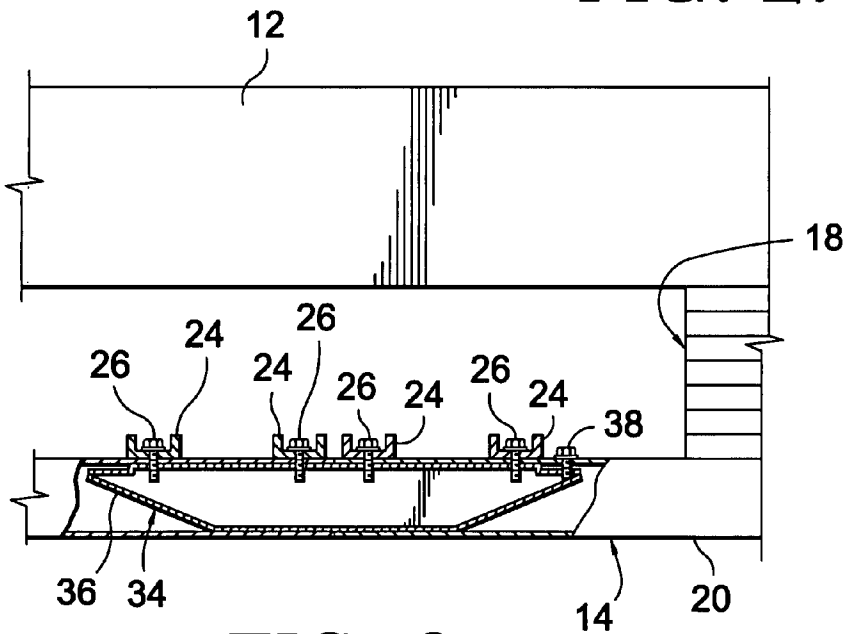
FIG. 3 is an enlarged view of the encircled region labeled 3 in FIG. 2, with parts broken away to show particular details of construction.

The barrier system 10 of the present invention may include a single section of impact wall 14 (not depicted), or may be formed of a plurality of impact wall 14 sections coupled with one another by splice units 34. In a particular preferred multi-section embodiment, such as that depicted in FIGS. 1 and 2, the preferred length of each impact wall 14 section is twenty (20) feet. In such a multi-section embodiment, internal "hidden" splice units 34 are slidably positioned within tubes 20 at the joints between impact wall sections 14 and serve to couple the impact wall sections 14 to one another at the adjoining ends of adjacent sections 14. In a preferred embodiment, the splice units 34 have beveled, sloped end faces 36 (as depicted in FIG. 3) and are constructed of ASTM A500 Grade C steel. The splice units 34 are coupled with the tubes 20 by one or more threaded brace bolts 26 which extend through an aperture or hole in the brace member 24, through an aperture or hole in the wall of the tube 20, and through an aperture or hole in the wall of splice unit 34, as best seen in FIG. 3. To couple together curved wall sections 14 used at turns or corners having a radius, the splice units 34 may be slightly curved or bent to conform to the face of wall sections 14 and the walls of the tubes 20. The splice units 34 are typically slidably connected with the tubes 20 by one or more threaded sliding splice bolts 38 fitted with a washer and extending through the tube slot 28 in the inner face of tube 20 and through an aperture or hole formed in the wall of the splice unit 34, as best seen in FIGS. 3 and 6. When brace bolts 26 and splice bolts 38 are removed or loosened sufficiently, the splice units 34 may slide and telescope within tubes 20, as will be further discussed below. It will be understood that sliding splice bolts 38 may be eliminated in some non-longitudinal barrier applications, as in installations having substantially curved walls sections 14 that would not lend themselves to splice units 34 sliding and telescoping within the tubes 20.

The internal, "hidden" splice units 34 reduce the potential that the sections of impact wall 14 will separate or that the joints between the sections of impact wall 14 will open up when a vehicle impacts the wall 14. The outer edges of the tubes 20 or wall sections 14 may be beveled at the wall 14 or tube 20 ends, such that the joints between sections of the impact wall 14 have a shallow, flat V-shaped indentation. In addition, in the event a vehicle strikes the impact wall 14 at or near a splice unit 34, the beveled end faces 36 of the splice units 34 and the beveled edges of the tubes 20 or walls 14 serve to minimize the potential that an edge or corner of the splice unit 34 will penetrate the wall of a tube 20 and contact or snag the impacting vehicle, or that an impacting vehicle will snag on an impact wall 14 joint. The configuration of the splice units 34 also results in a "bidirectional" joint between sections of impact wall 14, in that the beveled end faces 36 of splice units 34 also ensure that the face of the impact wall 14 will remain substantially smooth, continuous, and snag- and pocket-free regardless of the direction of travel of the impacting vehicle. Finally, the splice units 34 allow for relatively rapid and easy replacement of impact wall 14 sections when necessary, as will be further discussed below.

As best seen in FIGS. 5 and 7, cable restraint assemblies 16 are positioned along and between the containment wall 12 and the impact wall 14 and serve to removably couple impact wall 14 with containment wall 12. In a preferred embodiment, the cable restraint assemblies 16 are positioned along and between the walls 12 and 14 at approximately ten (10) foot intervals. As seen in FIG. 7, the cable restraint assembly 16 generally consists of a cable 40 (preferably ⅜" diameter galvanized wire rope), a ferrule 42 fixed to an end of the cable 40, and a threaded rod 44 fixed to the other end of the cable 40. A keyhole plate 46 is positioned over the aperture 30 in the wall of the tube 20 and attached to the wall of the tube 20 as by welding. The keyhole plate 46 has a partially threaded keyhole aperture 48 which receives the ferrule 42 and a keyhole bolt or plug 50, as seen in FIGS. 5 and 7. An internally threaded sleeve 52 is embedded in the containment wall 12, as best seen in FIGS. 4 and 7, and receives the threaded rod 44. Wall 12 is thus coupled to wall 14 by placing ferrule 42 through aperture 48 and sliding the cable 40 downwardly into position in aperture 48. Plug 50 is then threaded into the upper, threaded portion of aperture 48. Sleeve 52 is anchored in wall 12 and the rod 44 is threaded into the sleeve 52. In one embodiment (not depicted), the sleeve 52 and cable 40 extend through the entire thickness of the containment wall 12 to provide additional cable anchorage strength. It will be understood that other mechanical coupling systems having threaded, bolted, hooked, or relatively quick-release connection mechanisms known to persons skilled in the art may be used to removably couple impact wall 14 with containment wall 12. The cable restraint assemblies 16 or other coupling mechanisms serve to position the impact wall 14 adjacent the containment wall 12, hold the impact wall 14 in an upright, vertical position, prevent the impact wall sections 14 from pulling away from the containment wall 12, and act to spread the impact load over a greater length of the barrier system 10 by reducing the total amplitude and increasing the period of the bending wave induced in the tubes 20 that comprise the impact wall 14.

As best seen in FIGS. 1 and 4, energy-absorbing cartridges 18 are positioned between containment wall 12 and energy-absorbing impact wall 14. In a preferred embodiment, energy-absorbing cartridges 18 consist of seven (7) DOW or OWENS CORNING extruded polystyrene foam sheets 54, each approximately two (2) inches thick and having a 15 psi stress rating, sandwiched together to form an energy-absorbing cartridge approximately fourteen (14) inches thick and twenty (20) inches in width. Cartridges 18 are held in position between walls 12 and 14 by friction between the foam sheets 54 themselves, friction between the outermost foam sheet 54 and the wall 14, and friction between the innermost foam sheet 54 and the wall 12. The cartridges 18 also fit relatively snugly between walls 12 and 14 and the cable 40 is relatively taught, such that no significant gaps exist between the walls 12 and 14 and the cartridges 18 sandwiched between them.

It will be understood that the energy-absorbing cartridges 18 may be constructed of any number of materials and configurations, including polystyrene foam sheets or blocks, expanded bead polystyrene foam, friable polyurethane foam sheets or blocks of varying or constant thicknesses widths, or rubber or HDPE cylinders or tubes positioned in individual or concentric, telescoping fashion between the walls 12 and 14. The energy-absorbing barrier system 10 of the present invention may be "tuned" to accommodate virtually any impact condition by adjusting the cartridge 18 material, thickness, width, height, stress rating, and configuration. It will be understood, for example, that cartridges 18 may consist of a number of sheets 54 or blocks having varying widths so that a cartridge 18 has a substantially T-shaped or trapezoidal cross-section as seen from a plan view. The cartridges 18 are relatively easy to remove from and reinstall between wall 12 and wall 14 to enable the user to tune the stiffness and other performance characteristics of the barrier system 10 to match the expected impact conditions for a given site, such as impact speed, vehicle type and weight, and impact angle, and to replace compressed, crushed, cracked, or otherwise damaged cartridges.

In one tested embodiment of the barrier system 10 of the present invention, the energy-absorbing cartridges 18 consisted of seven (7) stacked sheets 54 of OWENS CORNING extruded polystyrene foam having a rating of 15 psi, each sheet 54 having a thickness of two (2) inches, a width of twenty (20) inches, and a height of forty (40) inches. The multi-sheet cartridges 18 were spaced along and between walls 12 and 14 at approximately ten (10) foot intervals on center. This embodiment was tested with an Indy open-wheel style vehicle weighing approximately 2,035 lbs. striking the face of the impact wall 14 at an approximate speed of 143 m.p.h. and an angle of approximately 20.7 degrees. The vehicle contacted the impact wall 14 at a point approximately ten (10) feet upstream of a joint between impact wall sections 14 and slightly downstream of a cartridge 18, and exited the impact wall 14 at a velocity vector angle of approximately 4.5 degrees. With this particular tube 20 and cartridge 18 configuration, the tests indicated that the impact wall 14 did not contact or "bottom out" on the containment wall 12 and that the deceleration forces applied to the impacting vehicle and its occupant were substantially mitigated. It will be understood persons skilled in the art that the barrier system 10 may readily be tuned for specific applications. The number, material, and dimensions of tubes 20, the spacing of cartridges 18, and the configuration, thicknesses, and widths of foam sheets 54 all may be adjusted depending upon several factors, including the expected impact angle, impact velocity, and vehicle type(s) (e.g. INDY open-wheel type and/or WINSTON CUP type vehicle, standard car, truck, etc.).

The barrier system 10 of the present invention may be continuous and surround the entire periphery of a race track or road way, or the system 10 may be positioned at select locations along the periphery of the track or roadway, at turns or high-speed corners, for example. In the event the barrier system 10 is not continuous, transition sections 56 may be provided at the upstream and/or downstream ends of the impact wall 14, as seen in FIGS. 1 and 6. These transition sections 56, as the name implies, provide a smooth transition from the containment wall 12 to the impact wall 14 and reduce the likelihood of a vehicle impacting and snagging on the blunt end of a section of the impact wall 14. Transition sections 56 may be constructed of tubular members like those of wall 14, and may be coupled with the adjacent impact wall section 14 by splice units similar to those previously described herein.

In operation, an errant vehicle strikes the face of the impact wall 14. The hollow structural steel tubes 20 which comprise the impact wall 14 deflect towards the containment wall 12, compressing and/or crushing the energy-absorbing cartridges 18 between the deflected impact wall 14 and containment wall 12. To ensure that vehicle and driver deceleration forces are minimized, the tubes 20 and cartridges 18 are configured and spaced such that the deflecting impact wall 14 will not contact or "bottom out" on the substantially rigid containment wall 12, as discussed above. The energy of the impacting vehicle is absorbed by the elastic and/or plastic deformation of the tubes 20, the compression and/or crushing of the energy-absorbing cartridges 18, and the crumpling or crushing of portions of the impacting vehicle itself.

In the event of a extremely high-speed impact, a tube or tubes 20, an entire impact wall section 14, and/or one or more cartridges 18 may become plastically deformed or otherwise damaged such that replacement of a section of impact wall 14 and/or one or more cartridges 18 is desired. The barrier system 10 of the present invention allows for relatively quick and easy repair and replacement of a damaged section of impact wall 14. To replace such a section, the cable restraint assembly 16 must be uncoupled from the impact wall 14, and the splice units 34 on each end of the section to be replaced must be slidably removed from the tubes 20 of the section 14 to be replaced. To accomplish this, the brace bolts 26 and sliding splice bolts 38 are typically first removed or loosened sufficiently such that the splice units 34 are disengaged from the walls of the tubes 20 and may slide and telescope within the tubes 20. The sliding splice bolts 38 are generally grasped and pulled to the side along the length of the tube slots 28 until the splice units 34 completely clear the joint between the section of impact wall 14 to be replaced and the adjacent section(s). The threaded keyhole plug 50 is then removed from the keyhole aperture 48. The ferrule 42 and cable 40 are slid upwards from the slot in the aperture 48 into the larger diameter hole portion of the aperture 48 such that the ferrule may be removed from the keyhole aperture 48. The damaged section 14 may then be removed, and a new, undamaged section 14 installed in its place by coupling the new section 14 to the adjacent section(s) 14 via the splice units 34 and by coupling the new section 14 to the containment wall 12 via the cable restraint assemblies 16. In the event one or more energy-absorbing cartridges 18 are cracked, crushed, plastically deformed, or otherwise damaged, new cartridges 18, or parts thereof, may be readily replaced. This is accomplished by removing the damaged cartridge(s) 18 and positioning the new cartridge(s) 18 against the containment wall 12 before a wall section 14 is installed or by simply sliding new cartridge(s) 18 between already-installed and coupled walls 12 and 14.

It will be seen from the foregoing that this invention is one well adapted to attain the ends and objects set forth above, and to attain other advantages which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described above. Rather, all matter shown in the accompanying drawings or described above is to be interpreted as illustrative and not limiting.

We claim:

1. An energy-absorbing vehicle barrier system, comprising:

a substantially rigid outer containment wall;

an inner, energy-absorbing impact wall spaced from said containment wall, said impact wall having an interior face facing said containment wall and a vehicle-side exterior face, said exterior face presenting a substantially smooth, uniform surface, said impact wall comprising a plurality of impact wall sections in end-to-end, abutting relation, said impact wall sections each comprising a plurality of tubes coupled with one another;

a coupling assembly adapted to removably couple said impact wall to said containment wall; and at least one energy-absorbing cartridge positioned between said impact wall and said containment wall.

2. The barrier system of claim 1, said system further comprising at least one splice unit coupled between adjacent said wall sections.

3. The barrier system of claim 1, wherein said exterior face of said impact wall is coated with a substantially smooth, friction-resistant material.

4. The barrier system of claim 1, wherein said energy-absorbing cartridge is at least one foam member.

5. The barrier system of claim 1, wherein a plurality of said cartridges are positioned between said impact wall and said containment wall in spaced relation to one another.

6. The barrier system of claim 1, wherein said energy-absorbing cartridge is at least one tubular member.

7. The barrier system of claim 1, wherein said coupling assembly includes a cable having a first end and a second end, said first end fixed to said containment wall and said second end removably coupled with said impact wall.

8. The barrier system of claim 2, wherein each said splice unit is a member slidably engaged with corresponding said impact wall sections.

9. The barrier system of claim 8, wherein each said splice unit has a pair of beveled ends, said ends received in adjacent said impact wall sections.

10. The barrier system of claim 1, wherein said tubes are hollow structural steel members having a rectangular cross section.

11. The barrier system of claim 10, wherein said tubes are coupled with one another by discontinuous welds.

12. The barrier system of claim 1 further comprising a transition section having first and second ends, said first end of said transition section coupled with an end of said impact wall, and said second end of said transition section coupled with said containment wall.

13. The barrier system of claim 1, wherein said tubes are constructed of ASTM A500 Grade C steel.

14. An energy-absorbing vehicle barrier system for use in an environment having a substantially rigid containment wall, comprising:

an inner, energy-absorbing impact wall spaced from the containment wall, said impact wall having an interior face facing said containment wall and a vehicle-side exterior face, said exterior face presenting a substantially smooth, uniform surface, said impact wall comprising a plurality of impact wall sections in end-to-end, abutting relation, said impact wall sections each comprising a plurality of tubes coupled with one another;

means for removably coupling said impact wall to the containment wall; and at least one energy-absorbing cartridge positioned between said impact wall and the containment wall.

15. The barrier system of claim 14, said system further comprising means for removably coupling together adjacent said wall sections.

16. The barrier system of claim 14, wherein said energy-absorbing cartridge is at least one foam member.

17. The barrier system of claim 14, wherein a plurality of said cartridges are positioned between said impact wall and said containment wall in spaced relation to one another.

18. The barrier system of claim 14, wherein said exterior face of said impact wall is coated with a substantially smooth, friction-resistant material.

19. The barrier system of claim 14, wherein said tubes are constructed of ASTM A500 Grade C steel.

20. The barrier system of claim 14, wherein said energy-absorbing cartridge is at least one tubular member.

21. The barrier system of claim 14, wherein said tubes are hollow structural steel members having a rectangular cross section.

22. The barrier system of claim 21, wherein said tubes are coupled with one another by discontinuous welds.

23. The barrier system of claim 14, further comprising a transition section having first and second ends, said first end of said transition section coupled with an end of said impact wall, and said second end of said transition section coupled with the containment wall.

24. The barrier system of claim 14, wherein an edge of said exterior face of said impact wall is beveled.

* * * * *